US010738587B2

(12) United States Patent
Sehsah et al.

(10) Patent No.: US 10,738,587 B2
(45) Date of Patent: Aug. 11, 2020

(54) MONITORING OPERATING CONDITIONS OF A ROTARY STEERABLE SYSTEM

(71) Applicant: Saudi Arabian Oil Company, Dhahran (SA)

(72) Inventors: Ossama R. Sehsah, Al Khobar (SA); Mohammed A. Alkhowaildi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 26 days.

(21) Appl. No.: 15/971,701

(22) Filed: May 4, 2018

(65) Prior Publication Data

US 2019/0338628 A1 Nov. 7, 2019

(51) Int. Cl.

| | |
|---|---|
| ***E21B 44/00*** | (2006.01) |
| ***E21B 7/06*** | (2006.01) |
| ***E21B 47/09*** | (2012.01) |
| ***E21B 47/12*** | (2012.01) |
| ***E21B 47/007*** | (2012.01) |
| ***E21B 47/07*** | (2012.01) |

(52) U.S. Cl.

CPC ..... *E21B 44/00* (2013.01); *E21B 7/062* (2013.01); *E21B 47/007* (2020.05); *E21B 47/07* (2020.05); *E21B 47/09* (2013.01); *E21B 47/12* (2013.01)

(58) Field of Classification Search

CPC ..... E21B 44/00; E21B 7/062; E21B 47/0006; E21B 47/065; E21B 47/09; E21B 47/12

See application file for complete search history.

(56) References Cited

U.S. PATENT DOCUMENTS

| | | | |
|---|---|---|---|
| 5,813,480 | A | 9/1998 | Zaleski, Jr. et al. |
| 6,092,610 | A | 7/2000 | Kosmala et al. |
| 7,013,729 | B2 | 3/2006 | Knudsen et al. |
| 7,373,975 | B2 | 5/2008 | Dion et al. |

(Continued)

FOREIGN PATENT DOCUMENTS

| | | |
|---|---|---|
| WO | WO-2015/054432 A1 | 4/2015 |
| WO | WO-2016/134519 A1 | 9/2016 |

(Continued)

OTHER PUBLICATIONS

Invitation to Pay Additional Fees Form PCT/ISA/206 for PCT/IB2018/056520, 8 pages (dated Feb. 22, 2019).

(Continued)

*Primary Examiner* — Nicole Coy
*Assistant Examiner* — Yanick A Akaragwe
(74) *Attorney, Agent, or Firm* — Choate, Hall & Stewart LLP; Charles E. Lyon; Peter A. Flynn

(57) ABSTRACT

An example drilling system includes a rotary steerable system (RSS) having an inner shaft configured to rotate during drilling performed by the drilling system. One or more sensors are associated with the inner shaft to obtain one or more readings based on the drilling performed by the RSS. One or more processing devices may receive data based on the sensor readings and process that data in order to generate an output based on the sensor readings. The data may relate to stresses on the inner shaft and the data may be used for purposes including, but not limited to, controlling operation of the RSS in real-time, determining current condition of the RSS, and estimating a potential life expectancy of the RSS.

21 Claims, 6 Drawing Sheets

(56) References Cited

U.S. PATENT DOCUMENTS

| | | | | |
|---|---|---|---|---|
| 8,215,417 | B2 | 7/2012 | Annaiyappa et al. | |
| 8,874,383 | B2 | 10/2014 | Gambier et al. | |
| 9,086,348 | B2 | 7/2015 | Thigpen et al. | |
| 9,624,729 | B2 * | 4/2017 | Sullivan | E21B 10/00 |
| 9,732,584 | B2 | 8/2017 | Roddy et al. | |
| 2003/0010534 | A1 * | 1/2003 | Chen | E21B 7/067 175/61 |
| 2005/0150689 | A1 | 7/2005 | Jogi et al. | |
| 2007/0215343 | A1 * | 9/2007 | McDonald | E21B 4/006 166/105 |
| 2011/0030963 | A1 * | 2/2011 | Demong | E21B 43/26 166/313 |
| 2012/0271576 | A1 * | 10/2012 | Kamel | H02J 13/0006 702/62 |
| 2013/0341095 | A1 | 12/2013 | Perrin et al. | |
| 2014/0262514 | A1 * | 9/2014 | Beylotte | E21B 44/00 175/40 |
| 2015/0034311 | A1 * | 2/2015 | Tunget | E21B 7/20 166/250.14 |
| 2015/0134390 | A1 * | 5/2015 | Hildebrand | G06Q 10/06312 705/7.15 |
| 2015/0160101 | A1 * | 6/2015 | Gao | G01M 13/028 702/6 |
| 2015/0308191 | A1 | 10/2015 | Zhan et al. | |
| 2016/0061028 | A1 | 3/2016 | Teale et al. | |
| 2016/0290126 | A1 * | 10/2016 | Rendusara | E21B 47/12 |
| 2017/0089192 | A1 | 3/2017 | Rendusara et al. | |
| 2017/0114625 | A1 | 4/2017 | Norris et al. | |
| 2017/0370204 | A1 * | 12/2017 | Dahl | E21B 7/00 |
| 2018/0119545 | A1 * | 5/2018 | Clark | E21B 47/022 |
| 2019/0292895 | A1 * | 9/2019 | Cobb | H04L 47/21 |

FOREIGN PATENT DOCUMENTS

| | | | |
|---|---|---|---|
| WO | WO-2016/148880 | A1 | 9/2016 |
| WO | WO-2017/035041 | A1 | 3/2017 |

OTHER PUBLICATIONS

International Search Report for PCT/IB2018/056520, 6 pages (dated Apr. 15, 2019).
Written Opinion for PCT/IB2018/056520, 10 pages (dated Apr. 15, 2019).

* cited by examiner

MONITORING OPERATING CONDITIONS OF A ROTARY STEERABLE SYSTEM

TECHNICAL FIELD

This specification relates generally to a monitoring operating conditions of a rotary steerable system.

BACKGROUND

Directional drilling systems are configurable to control the orientation of a wellbore. In directional drilling—also called horizontal drilling—a non-vertical wellbore is drilled through a formation to reach a target, such as a water reservoir or a hydrocarbon reservoir. Directional drilling systems typically employ specialized downhole equipment to form non-vertical wellbores. A rotary steerable system (RSS) is a type of downhole drilling equipment that may be used for this purpose.

An RSS includes an inner shaft and a drill bit, among other components. The RSS may be controlled via commands provided by a surface computer system. The RSS may respond to those commands by bending the shaft in a specified direction while drilling. The RSS, however, is susceptible to damage caused during its operation or by downhole environmental conditions.

SUMMARY

An example drilling system includes a rotary steerable system (RSS) having an inner shaft configured to rotate during drilling performed by the drilling system. The example system includes one or more sensors associated with the inner shaft to obtain one or more readings based on drilling performed by the rotary steerable system. The example system also includes one or more processing devices to receive data based on the one or more readings and to process the data to generate an output based on the one or more readings. The example system may include one or more of the following features, either alone or in combination.

The drilling system may include a measurement-while-drilling assembly configured to receive the data, and to output the data to the one or more processing devices. The one or more processing devices of the drilling system may be part of a computing system located on a surface, and the rotary steerable system may be located downhole relative to the surface.

The drilling system may include one or more vibrational sensors to sense vibration during rotation of the shaft. The one or more readings may represent vibration of the shaft. The drilling system may include one or one or more torque sensors to sense torque during rotation of the shaft. The one or more readings may represent torque experienced by the shaft. The drilling system may include one or more erosion sensors to sense erosion of the shaft as a result of drilling. The one or more readings may represent erosion of the shaft. The drilling system may include one or more temperature sensors to sense a temperature of the shaft while drilling. The one or more readings may represent the temperature of the shaft. The drilling system may include one or more sensors including a combination of two or more of the following: one or more vibrational sensors to sense vibration during rotation of the shaft, one or more torque sensors to sense torque during rotation of the shaft, one or more erosion sensors to sense erosion of the shaft as a result of drilling, and one or more temperature sensors to sense a temperature of the shaft while drilling.

The output generated by the one or more processing device may include a life expectancy of the rotary steerable system. The output generated by the one or more processing devices may include a failure condition of the rotary steerable system. The failure condition may be based on a temperature exceeding a predefined maximum temperature. The failure condition may be based on a structural integrity of the shaft.

An example method includes associating one or more sensors with an inner shaft of a rotary steerable system. The inner shaft may rotate while drilling is performed using the rotary steerable system. The example method includes obtaining information based on readings from the one or more sensors during drilling. The readings include one or more conditions of the inner shaft. The example method includes processing the information to generate an output and using the output to control drilling, to generate a visual display, or both to control drilling and to generate the visual display. The example method may include one or more of the following features, either alone or in combination.

The obtained information may represent the readings and may be received at one or more processing devices directly from the one or more sensors. The one or more processing devices may use the output to control drilling, to generate the visual display, or both to control drilling and to generate the visual display.

The rotary steerable system may be located downhole and the one or more processing devices may be part of a computing system located at a surface.

Obtaining the information may include receiving data representing the readings at a measurement-while-drilling assembly. The measurement-while-drilling assembly may be connected to the rotary steerable system and may generate the information from the readings. The measurement-while-drilling assembly may generate the information and the information may be received at one or more processing devices from the measurement-while-drilling assembly.

The rotary steerable system and the measurement-while-drilling assembly may be located downhole and the one or more processing devices may be part of a computing system located at a surface.

The one or more sensors may include one or more vibrational sensors to sense vibration during rotation of the shaft. The readings may represent vibration of the shaft. The one or more sensors may include one or more torque sensors to sense torque during rotation of the shaft. The readings may represent torque experienced by the shaft. The one or more sensors may include one or more erosion sensors to sense erosion of the shaft as a result of drilling. The readings may represent erosion of the shaft. The one or more sensors may include one or more temperature sensors to sense a temperature of the shaft while drilling. The readings may represent the temperature of the shaft. The one or more sensors may include a combination of two or more of the following: one or more vibrational sensors to sense vibration during rotation of the shaft, one or more torque sensors to sense torque during rotation of the shaft, one or more erosion sensors to sense erosion of the shaft as a result of drilling, and one or more temperature sensors to sense a temperature of the shaft while drilling.

The output may include the life expectancy of the rotary steerable system or failure condition of the rotary steerable system. The failure condition may be based on a temperature exceeding a predefined maximum temperature. The failure condition may be based on a structural integrity of the shaft. The methods may include calibrating the one or more sensors before drilling. The output may include an efficiency rating for the rotary steerable system. The efficiency rating may be determined by comparing the readings to readings from one or more other sensors uphole of the rotary steerable system.

Any two or more of the features described in this specification, including in this summary section, can be combined to form implementations not specifically described in this specification.

The systems, techniques, and processes described in this specification, or portions of the systems, techniques, and processes, can be implemented as, controlled by, or both implemented as and controlled by, a computer program product that includes instructions that are stored on one or more non-transitory machine-readable storage media, and that are executable on one or more processing devices to control (e.g., coordinate) the operations described herein. The systems, techniques, and processes described in this specification, or portions of the systems, techniques, and processes, can be implemented as an apparatus, method, or electronic system that can include one or more processing devices and memory to store executable instructions to implement various operations.

The details of one or more implementations are set forth in the accompanying drawings and the description below. Other features and advantages will be apparent from the description and drawings, and from the claims.

DESCRIPTION OF THE DRAWINGS

Like reference numerals in different figures indicate like elements.

DETAILED DESCRIPTION

An example drilling system includes a rotary steerable system (RSS) having an inner shaft configured to rotate during drilling performed by the drilling system. One or more sensors are associated with the inner shaft to obtain one or more readings based on the drilling performed by the RSS. One or more processing devices, such as a computing system, are configured—for example, programmed—to receive data based on the sensor readings and to process that data in order to generate an output based on the sensor readings. For example, the data may relate to stresses on the inner shaft, which may be a result of downhole conditions such as temperature, vibrations, weight supported, erosion, or torque. The data may be used for purposes including, but not limited to, controlling operation of the RSS in real-time, determining current condition of the RSS, and estimating a potential life expectancy of the RSS. The current condition may include damage to the RSS, such as cracks or other faults.

The system may be configured to monitor the RSS in real-time. Real-time monitoring may be useful in determining when the RSS is about to fail or is approaching failure during operation. In this regard, in some implementations, real-time may include actions that occur on a continuous basis or track each other in time, taking into account delays associated with processing, data transmission, hardware, and the like.

Figure 1:
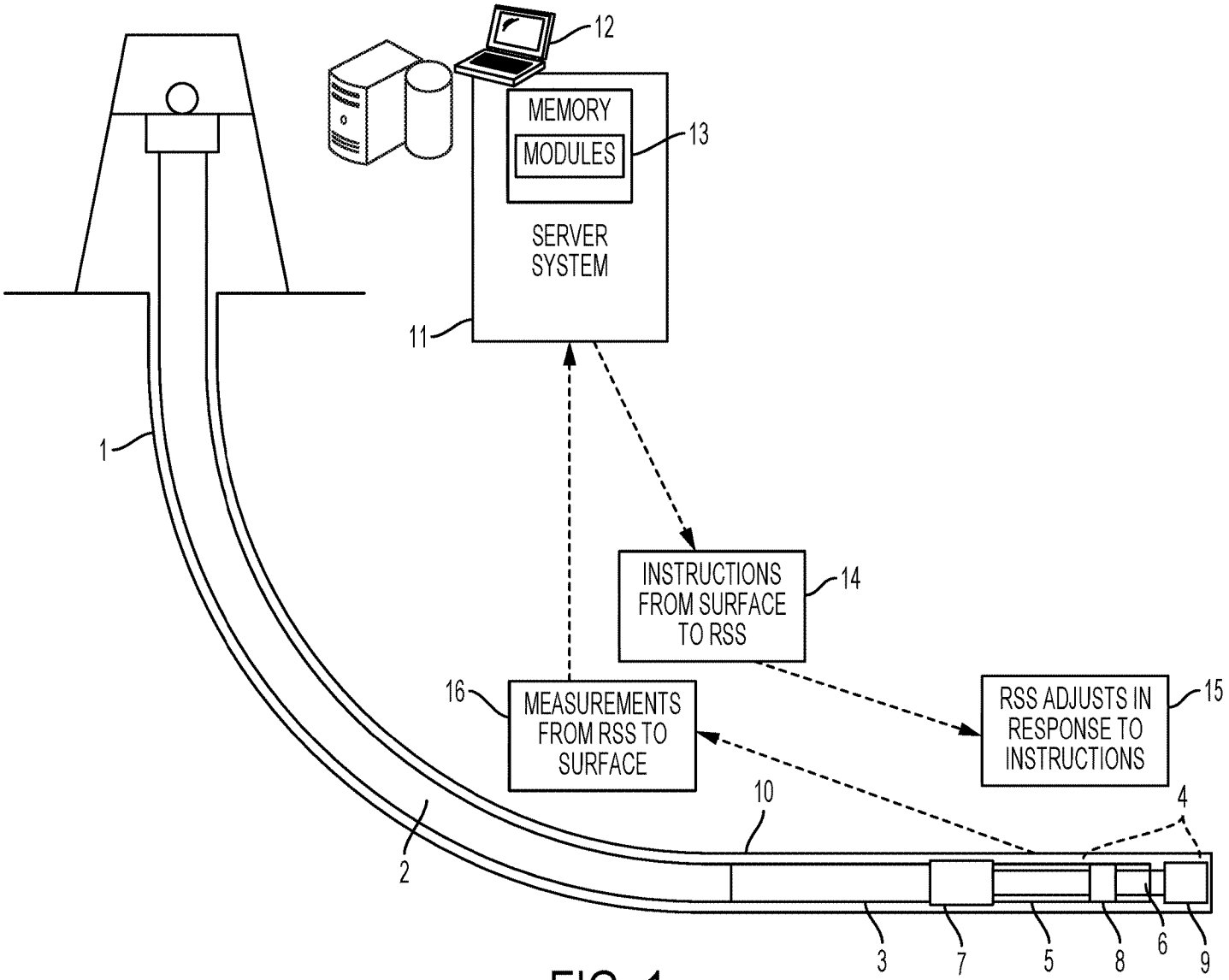
FIG. 1 is a cut-away, side view of an example oil drilling assembly using a rotary steerable system (RSS) for directional drilling.

FIG. 1 shows an example drilling system 1 that is configured to implement directional drilling. In this example, drilling system 1 includes a drill string 2 and downhole assembly 3. Downhole assembly 3 includes an RSS 4. RSS 4 includes a body 5 and an inner shaft 6. During drilling, inner shaft 6 rotates within body 5. Inner shaft is physically connected to a drill bit 9. Accordingly, the rotation of inner shaft 6 causes drill bit 9 also to rotate. In some implementations, the rotation of the inner shaft may be continuous and have a downward force component. The resulting rotation and downward force transfers to drill bit 9. This causes drill bit 9 to cut through rock and other materials in formation 10 in order to form the wellbore.

Body 5 includes an outer housing—also called a collar—8. Inner shaft 6 rotates within collar 8 during operation. RSS 4 is configured to adjust the drilling angle through movement of the inner shaft within the outer housing. Adjusting the drilling angle may include, but is not limited to, adjusting the inclination or the azimuth of the drilling. Any appropriate mechanisms may be used within the RSS to make the physical adjustment. Control over the adjustment may be implemented using a measurement while drilling (MWD) tool 7 located at an appropriate location downhole. In the example of FIG. 1, MWD tool 7 is located along the downhole components of drilling system 1.

In some implementations, MWD tool 7 may include one or more processing devices, examples of which are described in this specification. MWD tool 7 may also include signal conditioning components to receive and to process signals received from sources, such as an uphole- or surface-located computing system or the RSS. The signal conditioning components may be implemented using code executing on a processing device or solid state circuitry that is incorporated into the MWD tool.

As noted, an uphole computing system 11 may be configured—for example, programmed—to communicate with MWD tool 7 located downhole. Examples of computing systems that may be used to implement computing systems 11 are described in this specification. MWD tool 7 is communicatively coupled to computing system 11. In some implementations, both MWD tool 7 and computing system 11 may be configured to communicate wirelessly with each other. In some implementations, MWD tool 7 and computing system 11 may be connected using wires, such as Ethernet, for communication. In some implementations, communications between MWD tool 7 and computing system 11 may be a mix of wired and wireless communications.

Communications between MWD tool 7 and computing system 11 may include, but are not limited to, exchanges of status information. For example, the MWD tool may communicate, to the computing system, a location and operational status of the RSS. The location may be defined by position or depth downhole, in some examples. The operational status may include the rate of rotation or other parameters relating to the operation of the RSS. The status information may be usable to improve drilling. For example, the position of the RSS may be adjusted in response to the status information without stopping drilling. In some implementations, such adjustments may support improvements in rates of penetration (ROP) and drilling directional accuracy.

In some implementations, communications between MWD tool 7 and computing system 11 may be closed loop. In an example closed loop communication system, the receiver of a message repeats the message back to a sender of the message. The sender confirms the accuracy of the repeated messages to the receiver.

Figure 4:
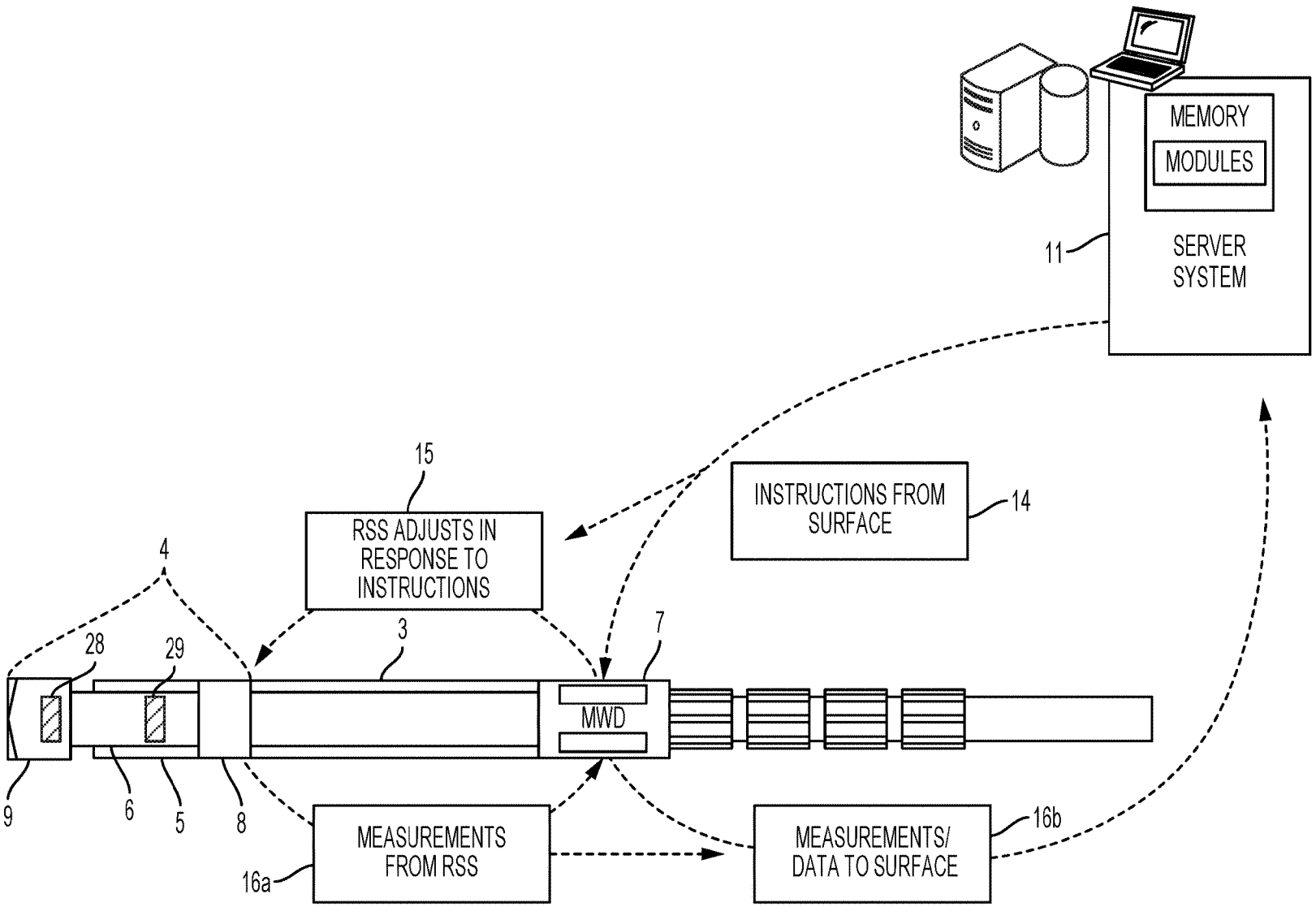
FIG. 4 is a side view of an example system that includes an RSS, a measurement while drilling (MWD) tool, and a communication loop to a surface computing system.

FIG. 4 depicts, conceptually, an example of a communication system that includes RSS 4, MWD tool 7, and computing system 11. In this example, MWD tool 7 receives instructions (14) from computing system 11. The instructions may be for controlling operation of the RSS or another component downhole. In some implementations, MWD tool 7 executes, interprets, or processes the received instructions to control the operation of RSS 4 as shown (15) in FIG. 4.

Control by the MWD tool may reduce the chances that the RSS will deviate from a programmed trajectory. In this regard, computing system 11 may generate a programmed trajectory for the RSS based, for example, on programming input received from a user or another device. The computing system may communicate this programmed trajectory to the MWD tool. The MWD tool may, in turn, control the trajectory of the RSS so that the trajectory of the RSS matches the programmed trajectory or stays within an envelope of the programmed trajectory.

In some implementations, to control the trajectory of the RSS, the MWD tool is configured to obtain the position and direction of the RSS in real-time, and to compare the obtained position and direction of the RSS with a position and direction of the RSS from the programmed trajectory. If there is a deviation between the obtained position and direction of the RSS and the position and direction of the RSS from the programmed trajectory, the MWD tool is configured to adjust, in real-time, the position and direction of the RSS towards the position and direction of the RSS from the programmed trajectory. For example, if the actual position of the RSS deviates by 10% in one direction from the position of the RSS in the programmed trajectory, the MWD tool may the position of the RSS by moving the RSS in the opposite direction by 10%.

Referring back to the example of FIG. 4, MWD tool 7 also receives information (16*a*), such as measurements or readings, from RSS 4. MWD tool 7 may simply relay the received information to computing system 11, or MWD tool 7 may interpret or process the received information and send resulting data (16*b*) to computing system 11 that is based on the received information. The information received at MWD tool 7 from the RSS may be received from one or more sensors placed on, adjacent to, or in the vicinity of, the inner shaft of the RSS. In some implementations, both MWD tool 7 and these sensors may be configured to communicate wirelessly with each other. In some implementations, MWD tool 7 and the sensors may be connected using wires, such as Ethernet, for communication. In some implementations, communications between MWD tool 7 and the sensors may be a mix of wired and wireless communications.

The sensors may be configured and arranged to obtain one or more readings relating to the inner shaft of the RSS based on drilling performed using the RSS. Examples of the sensors include, but are not limited to, one or more vibrational sensors to sense vibration during rotation of the shaft. In this example, the readings may represent the vibration of the shaft. Examples of the sensors include, but are not limited to, one or more torque sensors to sense torque during rotation of the shaft. In this example, the readings may represent the torque during rotation of the shaft. Examples of the sensors include, but are not limited to, one or more erosion sensors to sense erosion of the shaft. In this example, the readings may represent the erosion of the shaft resulting from rotation of the shaft or other conditions. Examples of the sensors include, but are not limited to, one or more temperature sensors to sense a temperature of the shaft or a downhole temperature where the shaft is located. In this example, the readings may represent the temperature of the shaft or the temperature adjacent to the shaft during rotation of the shaft. Examples of the sensors include, but are not limited to, one or more weight or load sensors to sense weight supported by the shaft. The sensors may include appropriate combinations of the previously-described sensors alone, or in combination with, other sensors not specifically mentioned. For example, other sensors may include pressure sensors to sense downhole pressure.

Readings from sensors associated with the inner shaft may be indicative of various drilling conditions. These readings may be sent to the MWD tool as described. In some implementations, the readings may be sent directly to computing system 11. Data based on the readings may be stored in computer memory 13 and executed programs by processing devices 17 of computer system 11 may process the data to monitor and track RSS conditions. This data may be used to log RSS usage and to determine an estimated remaining life of the RSS. This data may also be used to identify errors in the structure or operation of the RSS. For example, to detect an error, the computing system may compare the data with one or more baseline data ranges that may be stored in computer memory 13 (see FIG. 1). Computing system 11 may determine if there is an error if the data is outside the bounds of the one or more baseline ranges. In that case, the computing system may attempt to correct the error, to display an indication of the error on a display device, or to do both.

In this regard, inner shaft 6 may be subjected to more stress than other downhole components. The stress may be a result of torque transmitted from drill string 2 to inner shaft 6 or from the resistance of drill bit 9 attached to inner shaft 6 while cutting through formation 10. The stress may also result from vibrations caused by the drill string during operation. Weight supported by the RSS and the temperature downhole, among other conditions, may also contribute to the stress experienced by inner shaft 6. Stress on the inner shaft may cause the RSS to fail sooner than expected.

Figure 3A:
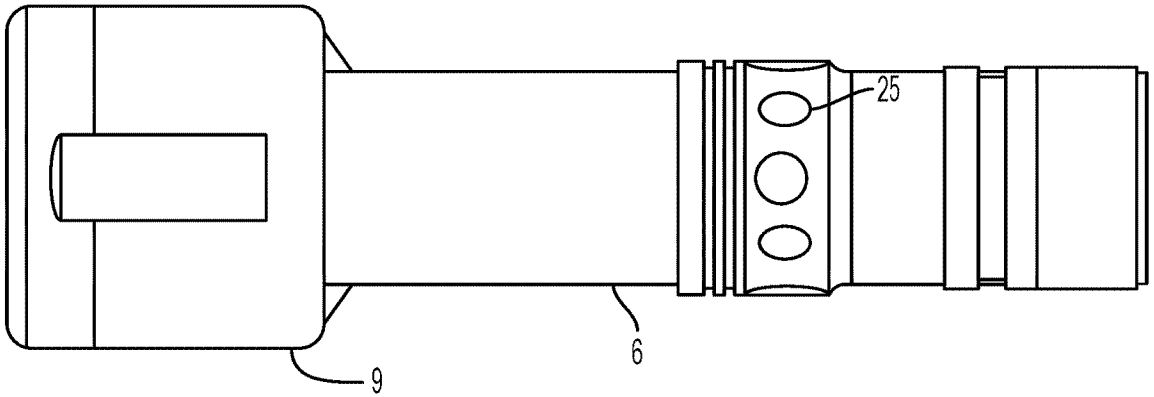
FIG. 3A is a cut-away, side view of an example inner shaft and drill bit assembly.
Figure 3B:
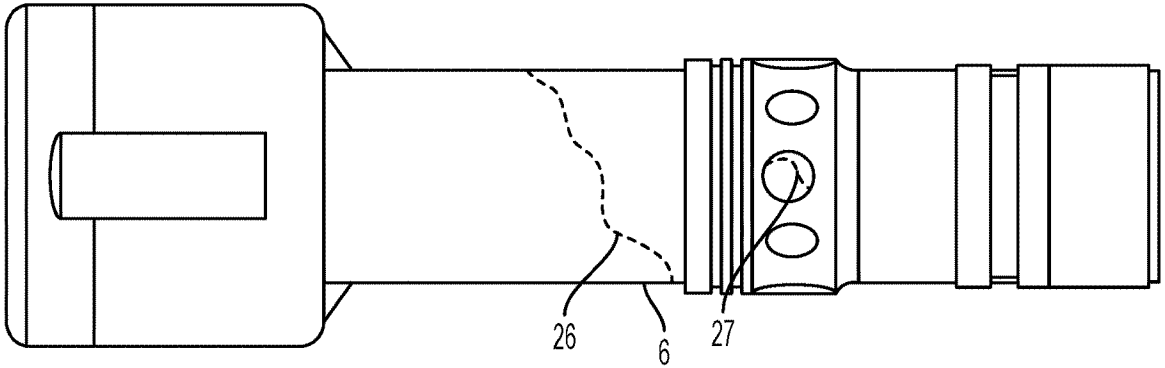
FIG. 3B is a cut-away, side view of an example RSS that is cracked.

RSS failure may happen in a number of ways. For example, inner shaft 6 rotates within the outer housing 8 through a bearing assembly 25 of FIG. 3A, which sits between outer collar or housing 8 and inner shaft 6. If the bearings are not centered, the shaft will rotate irregularly, which causes unnecessary friction and wear on the outer surface of the inner shaft. This can lead to a reduced diameter and cracking of the inner shaft. When an increase in friction occurs on the inner shaft, this can also cause the RSS to be subjected to higher temperatures which could also lead to early failure. Referring to FIG. 3B, a crack 26 may form on inner shaft 6 as a result of stress.

Another drilling incident that may lead to failure of the inner shaft is a stuck drill bit. A stuck drill bit is a drill bit lodged in the formation and unable to rotate. The force attempting to cause rotation of the drill bit in a stuck situation can create a sudden increased load on the inner shaft, which can also cause a crack to form in the inner shaft. After such a crack is formed, the crack may propagate in response to continual drilling pressure and lead to a twist-off. In a twist-off, the inner shaft breaks off completely. When this happens, drilling is halted and time must be spent in order to retrieve the broken-off piece. Additionally, the RSS must be replaced.

A location that may be the immediate cause of tool failure may be within a ball pocket of bearing assembly 25. Mechanical damage at this point can lead to a fatigue crack 27 across the ball pocket of bearing assembly 25, This fatigue crack can propagate down inner shaft 6 and lead to a twist-off. In an example, damage may be due to excessive torque causing mini-cracks in the areas around the ball pockets and also at the contact points within the ball pockets, causing a crack along the inner shaft.

Real-time measurements associated with the RSS may help to predict early tool failure and to allow a worker to change drilling parameters to lower stress on the RSS during drilling. In some cases, lowering the stress on the RSS can prolong the life of the RSS and lessen unnecessary trips to change the RSS and subsequent operations, such as fishing, sidetrack cementing, and sidetracking.

Figure 3C:
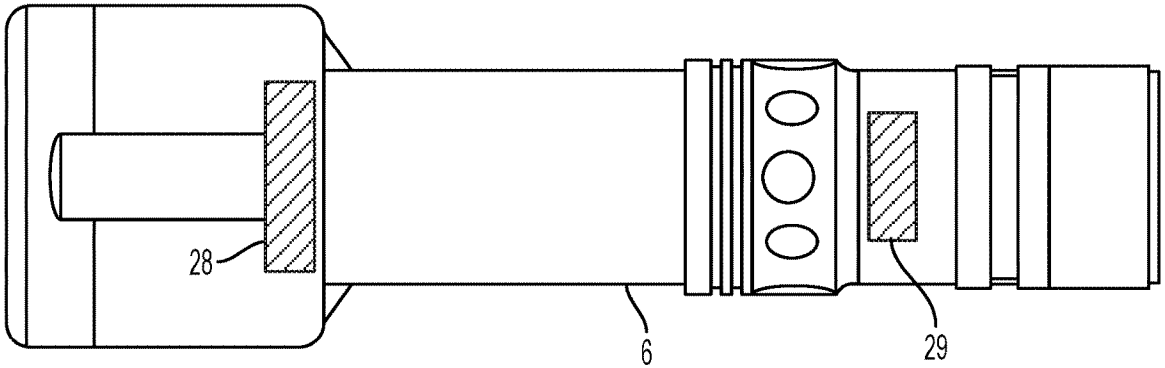
FIG. 3C is a cut-away, side view of an example RSS including sensors associated with its inner shaft.

The sensor readings or measurements may be used to detect, or to predict, failures in the RSS, such as those described previously. Example sensor placement is shown in FIGS. 3C and 4. Sensors 28 and 29 may represent different types of sensors that may be associated with inner shaft 6. For example, these sensors may be placed within a pocket or cavity that is formed within the body of inner shaft 6. In this example, inner shaft 6 may be manufactured with the cavity or the cavity may be formed post-manufacture. Materials used to produce the inner shaft may be selected to account for, or to compensate for, lesser thickness of the shaft at locations proximate to the cavity.

Sensors may be placed at various locations along inner shaft 6. For example, there may be two sensors of the same type placed at different locations along the inner shaft. In an example, these sensors may be placed to span a portion of the inner shaft expected to experience a large amount of stress or stress that exceeds a predefined maximum. In this regard, the inner shaft may experience different conditions at different locations. One or more sensors may be placed at a point on the inner shaft nearest to the drill bit. Such sensors may provide information representing conditions near the connection points of the drill bit and the inner shaft, which could be a point of failure. Sensor measurements taken close to the drill bit may indicate that a drilling parameter should be adjusted or that drilling should be stopped and the RSS should be serviced. Drilling parameters may include, but are not limited to, parameters that affect the rate of penetration (ROP) of a drilling system, such as rotation speed or angle of the inner shaft, of the drill bit, or of both. Sensors may be placed in various locations in association with the RSS. Sensors may also be placed at uphole locations near or at the MWD tool of further uphole on the drill string. A number of sensors may be placed at different locations throughout drill string 2 and downhole assembly 3. Different types of sensors may be used, which could provide data of downhole drilling conditions.

As noted, an example of a sensor to measure downhole forces on inner shaft 6 may include a vibration sensor. Vibration sensors may be placed in locations on, or relative to, inner shaft 6. Example locations have been described previously, although different locations associated with the RSS may also be used. Data representing vibration measurements obtained from the sensors may be sent wirelessly to MWD tool 7 or to computing system 11. At computing system 11 or elsewhere, the data may be compared to baseline data representing acceptable vibrations for the inner shaft. A comparison to the baseline may indicate that vibration experienced by the inner shaft is excessive. If there is excessive vibration, appropriate drilling parameters may be adjusted in attempts to reduce the vibrations on the drill bit. This may be done in order to prolong the life of the RSS. Vibration close to the drill bit may indicate that a drilling parameter should be adjusted or that drilling should be stopped and the RSS should be serviced. Drilling parameters that may be adjusted can include, but are not limited to, parameters that affect the rate of penetration (ROP) of a drilling system, such as rotation speed or angle of the inner shaft, of the drill bit, or of both. Examples of vibration sensors that may be used include, but are not limited to, accelerometers, piezoelectric sensors, and micro-electromechanical (MEMS) devices. The placement of the vibration sensors can be at different locations on or near the RSS.

As noted, another example of a sensor to measure downhole forces on RSS 4 includes a torque sensor. Torque sensors may be placed in different locations on, or relative to, inner shaft 6. Example locations are described previously. Data from these sensors may represent the torque on inner shaft 6 resulting from rotation of the drill when cutting through a formation or the torque on inner shaft 6 resulting from rotation of drill string 1. Torque sensors may be placed at different locations along inner shaft 6. For example, there may be two torque sensors placed at different locations along the inner shaft 6. In an example, these sensors may be placed to span a portion of the inner shaft expected to experience a large amount of torque or torque that exceeds a predefined maximum. In this regard, the inner shaft may experience different torque at different locations. The portion nearest the drill bit may experience a higher torque than a portion of the shaft uphole, closer to MWD tool 7. Accordingly, one or more torque sensors may be placed at a point on inner shaft 6 nearest to drill bit 9. Such sensors may provide information representing conditions near the connection points of the drill bit and the inner shaft, which could be a point of failure. Two torque sensors may span the connection between drill bit 9 and inner shaft 6 or the connection between inner shaft 6 and MWD tool 7. Data representing torque obtained from the sensors may be sent wirelessly to MWD tool 7 or to computing system 11. At computing system 11 or elsewhere, the data may be compared to baseline data representing acceptable torque on the inner shaft. A comparison to the baseline may indicate that torque experienced by the inner shaft is excessive. If there is excessive torque, appropriate drilling parameters may be adjusted in attempts to reduce the torque on the inner shaft. Drilling parameters that may be adjusted can include, but are not limited to, parameters that affect the rate of penetration (ROP) of a drilling system, such as rotation speed or angle of the inner shaft, of the drill bit, or of both. This may be done in order to prolong the life of the RSS. Examples of torque sensors that may be used include, but are not limited to, strain gauges and angular position sensors. The placement of the torque sensors can be at different locations on or near the RSS.

As described, another example of a sensor to measure downhole forces on inner shaft 6 may include a weight sensor, such as an axial load sensor. Axial load sensors may also be used in order to measure the weight on the drill bit. In this regard, weight may constitute tension experienced by the inner shaft, compression experienced by the inner shaft, or both tension and compression. In some drilling systems, weight is measured from surface computing system 11 or from MWD tool 7. Axial load sensors may be placed at different locations on, or relative to, inner shaft 6. Example locations are described previously. However, in some implementations, mounting an axial load sensor close to drill bit 9 may more accurately detect the real-time weight on the drill bit than mounting the axial load sensor farther away. Data from these sensors may also represent the weight supported by inner shaft 6. Greater weights may subject the inner shaft to greater stress, making it more susceptible to buckling. Data representing the weight obtained from the sensors may be sent wirelessly to MWD tool 7 or to computing system 11. At computing system 11 or elsewhere, the data may be compared to baseline data representing acceptable weight supported. A comparison to the baseline may indicate that weight supported by the inner shaft is excessive. If there is excessive weight, appropriate drilling parameters may be adjusted or components of the drill string may be configured to relieve or to support the weight. Drilling parameters that may be adjusted can include, but are not limited to, parameters that affect the rate of penetration (ROP) of a drilling system, such as rotation speed or angle of the inner shaft, of the drill bit, or of both. This may be done in order to prolong the life of the RSS. Examples of axial load sensors that may be used include, but are not limited to, weight and load sensors. The placement of the axial load sensors can be on or near the RSS.

As noted, another example of a sensor to measure downhole conditions experienced by inner shaft 6 includes a temperature sensor. One or more temperature sensors may be placed at different locations on, or relative to, inner shaft 6. Example locations are described previously. Data from these sensors may represent the temperature experienced by inner shaft 6 during operation. Data representing temperature obtained from the sensors may be sent wirelessly to MWD tool 7 or to computing system 11. At computing system 11 or elsewhere, the data may be compared to baseline data representing acceptable temperature on, or proximate to, the inner shaft. A comparison to the baseline may indicate that temperature experienced by the inner shaft is excessive. If there is excessive temperature, appropriate drilling parameters may be adjusted in attempts to reduce the temperature downhole. Drilling parameters that may be adjusted can include, but are not limited to, parameters that affect the rate of penetration (ROP) of a drilling system, such as rotation speed or angle of the inner shaft, of the drill bit, or of both.

In an example, an acceptable formation temperature may be predetermined and stored as an acceptable condition 20 in computer memory 13. The formation temperature may be, for example, 350° Fahrenheit (F.). In some cases, temperature readings from sensors at the inner shaft 6 that are 200° F. to 300° F. above a formation temperature may result in system failure. Real-time measurements may also indicate when the temperature of the RSS inner shaft is rapidly increasing. If temperatures out of an acceptable range are detected, computing system 11 may send instructions to stop drilling or to adjust a drilling parameter, such as those described previously. The placement of the temperature sensors can be at different locations on or near the RSS.

As noted, an example of a sensor to measure downhole forces on inner shaft 6 includes an erosion sensor. Erosion sensors may be placed in other locations on, or relative to, inner shaft 6. In an example, erosion sensors may be placed on a surface of inner shaft 6. Sensors on the surface of the inner shaft may be used to measure RSS body conditions, such as erosion along the surface of the RSS. Data from these sensors may represent the erosion of inner shaft 6. In some examples, the erosion constitutes material lost from the outside of inner shaft 6. In some cases, erosion may occur when there is misalignment of bearing assembly 24, which can cause the inner shaft to rotate irregularly. This can cause unnecessary friction and wear between the inner shaft and RSS outer components. This wear on the inner shaft may produce cracks. Data representing erosion obtained from the sensors may be sent wirelessly to MWD tool 7 or to computing system 11. At computing system 11 or elsewhere, the data may be compared to baseline data representing an acceptable amount of erosion on the inner shaft. A comparison to the baseline may indicate that the erosion on the inner shaft is excessive. If there is excessive erosion, appropriate drilling parameters may be adjusted in attempts to reduce the erosion on the inner shaft. This may be done in order to prolong the life of the RSS. In some cases, if the erosion is serious enough, the RSS or components of the RSS may be replaced. The placement of the erosion sensors can be a different locations on or near the RSS. The sensors associated with the inner shaft may include any appropriate combination of the previously-described vibration sensors, torque sensors, weight sensors, temperature sensors, and erosions sensors. In some implementations, a single instance of each sensor may be associated with the inner shaft. In some implementations, multiple instances of each sensor or different types of sensors may be associated with the inner shaft. In some implementations, a single instance of a sensor may measure two of the previously-described parameters. For example, a single sensor may be configured to measure both temperature and vibration. Furthermore, sensors of the type described previously may be arranged uphole of RSS 4, and may be used to measure the same parameters as the sensors associated with inner shaft 6 of RSS 4. The processing associated with uphole sensors may be the same or similar as described in this specification for the sensors associated with the inner shaft.

Figure 2:
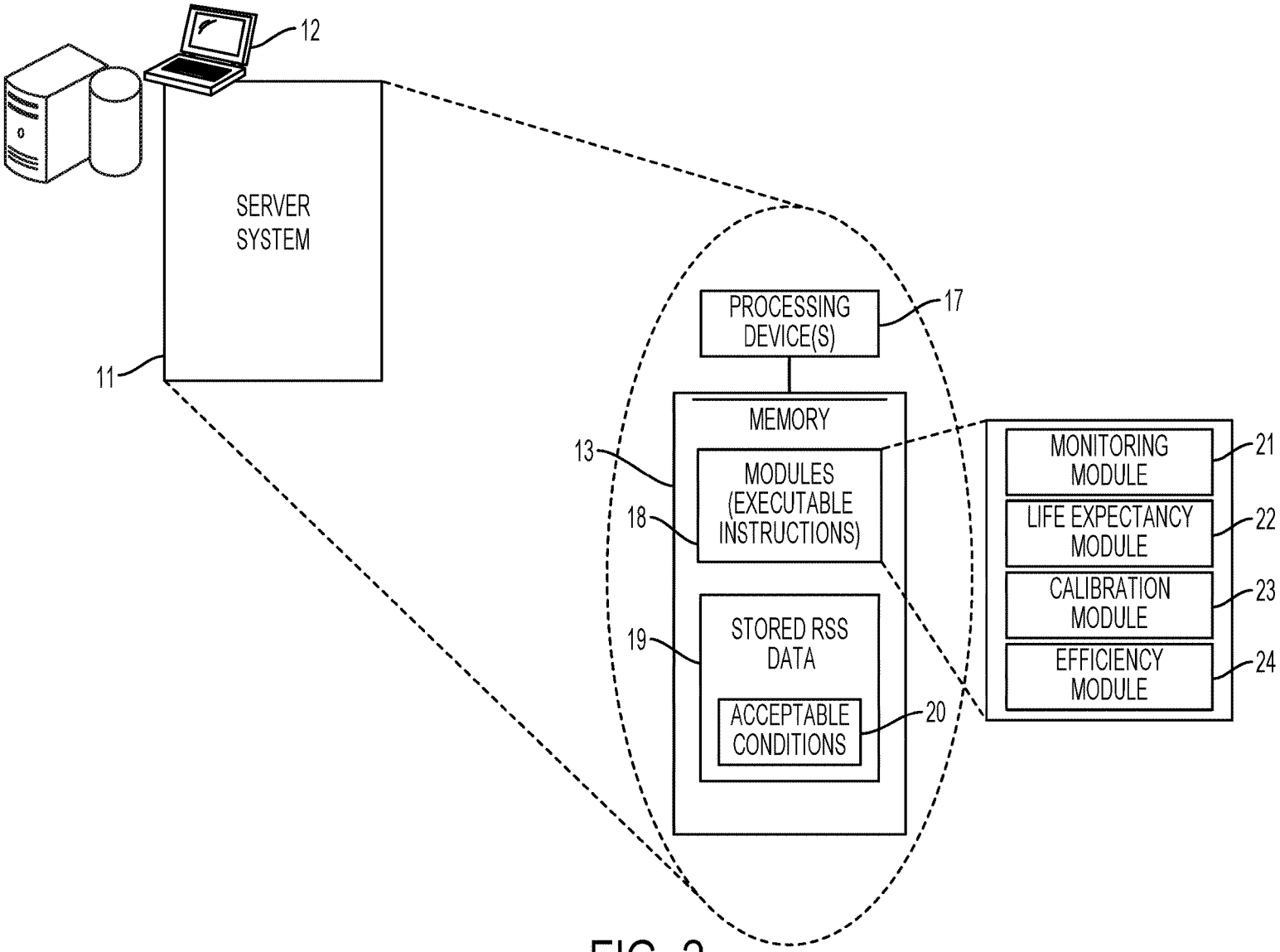
FIG. 2 is a block diagram representing an example of a computing system at a surface of the directional drilling system.

Referring to FIG. 2, computing system 11 includes display device 12 and computer memory 13. Computer memory 13 may contain stored RSS data 19 which may include acceptable conditions 20 of the RSS 4. Acceptable conditions 20 can be in the form of a range of acceptable conditions. These conditions can be acceptable measurements from different sensors associated with the RSS. For example, for each sensor associated with the RSS, there can be a stored range of measurements representing an acceptable condition associated with a sensor. There may be a range of acceptable temperatures that represent a range of acceptable temperatures that RSS 4 may be subjected to during drilling. Acceptable conditions 20 can be in the form of a baseline. For example, for each sensor associated with the RSS, there can be a stored baseline representing an acceptable condition associated with a sensor. The baseline may be the maximum acceptable temperature that RSS 4 may be subjected to during drilling. Stored RSS data 19 may include stored sensor data from the sensors associated with the RSS. Stored RSS data 19 may include information about RSS 4 including, but not limited to, the model, manufacturer, the time at which the RSS 4 was last used, the time at which the RSS was last calibrated and the time at which the RSS was last serviced. Computing system 11 may also include modules 18, which may be computer programs or routines stored in computer memory 13, and which include executable instructions that, when executed, perform a function or functions.

An example of a function performed by modules 18 may include comparing sensor data received from RSS 4 to stored acceptable conditions 20 such, as a baseline. A module may be monitoring module 21 and may function to monitor the condition of the RSS by comparing sensor data received from RSS 4 to stored acceptable conditions 20. In another example, the module may be life expectancy module 22 and may function to calculate the life expectancy of RSS 4. In another example, a module may be calibration module 23 and may function to calibrate sensors associated with RSS 4 or sensors located at different locations on drill string 2, before drilling or in between drilling operations. In another example, a module may be an efficiency module 24 and may function to determine the efficiency of RSS 4, drill string 2, or another component of the drill string. Modules 18 may also be executed to display a graphical output or alert on a display screen of display device 12. Modules 18 may also function to send instructions downhole to MWD tool 7 or to RSS 4. These instructions may be, for example instructions to stop drilling or adjust drilling parameters. Other functions not described may be performed by modules 18, which may depend on particular drilling operations or particular downhole assembly.

Regarding life expectancy module 22, the life expectancy of RSS 4 or other drilling components may be based on the duration of time spent drilling or the distance drilled. For example, life expectancy may be a prediction of when inner shaft 6 of RSS 4 will fail and may be determined by the amount of time RSS 4 has been drilling or the distance drilled. Manufacturers of drilling components may provide a predetermined life expectancy indicating how long a downhole assembly 3 or RSS 4 will last before failure. Life expectancy may be based on expected drilling conditions. If there are deviations from expected drilling conditions, such as moments or incidents during drilling when RSS 4 is subjected to high stress, the life expectancy may decrease. As a result, RSS 4 may reach failure before the reaching the end of the predetermined life expectancy.

Figure 5:
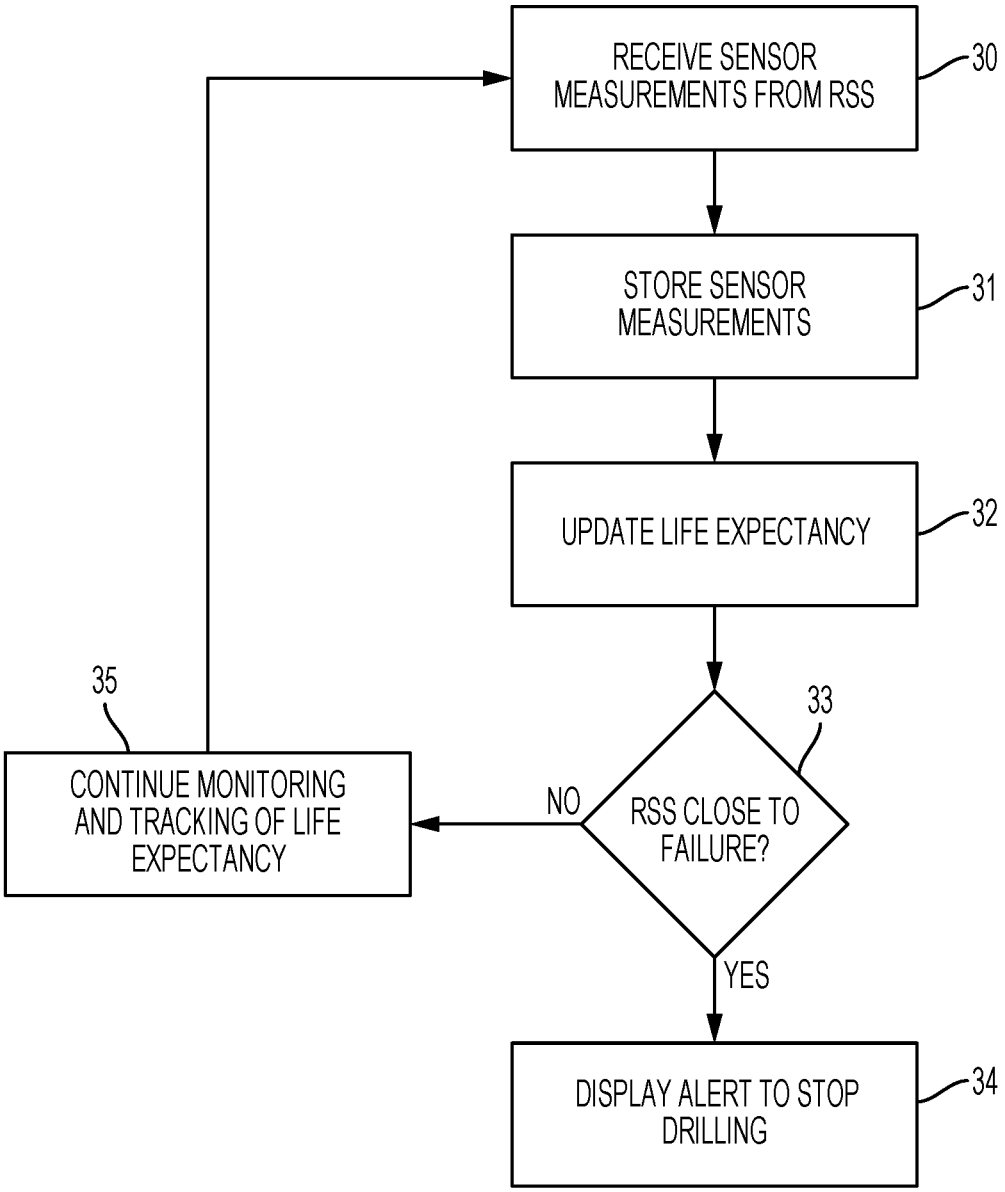
FIG. 5 is a flowchart showing an example process for monitoring the RSS using a calculated life expectancy.

In an example, the life expectancy of RSS 4 may be predicted using measurements from one or more sensors associated with the RSS 4. FIG. 5 is a flowchart showing example operations that may be performed by life expectancy module 22. As shown in the example of FIG. 5, life expectancy module 22 receives measurements from sensors (30) associated with the RSS. Examples of the sensors are described previously. The measurements are stored (31) in memory. Life expectancy module 22 updates (32) an ongoing estimation of the life expectancy of the RSS based on the received sensor measurements. Life expectancy may be a prediction, which can be based on different sensor measurements. Initially, RSS 4 may be assigned a life expectancy that predicts the duration of time before RSS 4 will fail. Sensor measurements received from RSS 4 as well as the time spent during drilling may be used to continually update (32) the predicted life expectancy. The predicted life expectancy of RSS 4 may be updated in real-time to reflect the time in which RSS 4 has been drilling, and may become shorter over time. The predicted life expectancy may be shortened additionally in response to the sensor measurements received. For example, if sensor measurements received by the efficiency module 24 are outside a range of acceptable conditions 20, the predicted life expectancy may be updated (32) to decrease the predicted life expectancy in addition to shortening the life expectancy based on the length of time drilling. The amount the life expectancy is shortened in response to sensor measurements may be related to the how far the sensor measurements exceed the acceptable conditions. Life expectancy may be updated based on measurements obtained from one or more sensors of the same or different types. Calculations used to update life expectancy may weight certain sensors, measuring particular conditions, to have a greater impact on the predicted life expectancy of RSS 4 than others. Calculations used to update life expectancy may also take into account where the sensor is located at RSS 4.

When calculating updated life expectancy (32), life expectancy module 22 determines the remaining life of RSS 4. Life expectancy module 22 may determine if RSS 4 is close to failure (33). It may be determined that RSS 4 is close to failure when the updated life expectancy (32) reaches a minimum value or lower limit. If RSS 4 is close to failure, for example if updated life expectancy (32) reaches the minimum value, life expectancy module 22 may send instructions to display an alert to stop drilling (34). If RSS 4 is not close to failure, for example if updated life expectancy (32) has not reached the minimum value, expectancy module 22 may continue monitoring RSS 4 and tracking the life expectancy (35). The minimum value could be any appropriate programmed amount of time and may indicate that RSS 4 is about to fail. A programmed minimum value or lower limit may be stored in computer memory 13 with stored RSS data 19. For example, the stored minimum value may be 30 minutes. In this example, if updated life expectancy (32) is less than or equal to 30 minutes, life expectancy module 22 may send instructions to display an alert to stop drilling (34). If updated life expectancy (32) is greater than 30 minutes, life expectancy module 22 may continue monitoring RSS 4 and tracking the life expectancy (35).

The alert or display may be on a screen of display device 12 to a worker at a drilling site. The alert or display may be on a smart phone of a worker on site or at a remote location. The alert may be in the form of a text or email wirelessly transmitted. The display may include colors that represent different values of predicted life expectancy. The display may show life expectancy in minutes, seconds, or hours of drilling, indicating the amount of time remaining before RSS 4 is predicted to fail. Additionally, the instructions from life expectancy module 22 to display an alert may include to signal to an alarm or lights, which may alert a worker at the drilling site or at a remote location.

If the minimum value is reached and RSS 4 is instructed to stop drilling, downhole assembly 3 may be pulled out of the hole and serviced. Predicting RSS failure and updating the predicted life expectancy may prevent RSS damage. In some cases, RSS 4 may be serviced and repaired, if necessary, and be further used for additional drilling operations. Life expectancy of RSS 4 may be tracked by life expectancy module 22 and stored in computer memory 13. Life expectancy can be tracked over multiple uses. Life expectancy may be calculated from one or more of the sensor measurements described or other from other types of sensors obtaining measurements for monitoring conditions of RSS 4. Additionally, initial life expectancy before use may be a predetermined amount of time or distance drilled. Initial life expectancy may also account for the planned direction of drilling, the planned type of formation drilled, or any additional combination of factors that can be determined prior to drilling and that may affect the life expectancy of RSS 4.

Another example module is monitoring module 21. Monitoring module 21 may function to receive sensor measurements from RSS 4 (36) and confirm that the drilling conditions are not subjecting RSS 4 to high amounts of stress or wear. Monitoring module 21 determines if measurements received from sensors associated with RSS 4 exceed a baseline or are outside of a range of acceptable conditions 20 stored in computer memory 13 of computing system 11. Sensor measurements may be received from different types of sensors associated with RSS 4 as described or may be different types of sensors that measure a condition of RSS 4.

Figure 6:
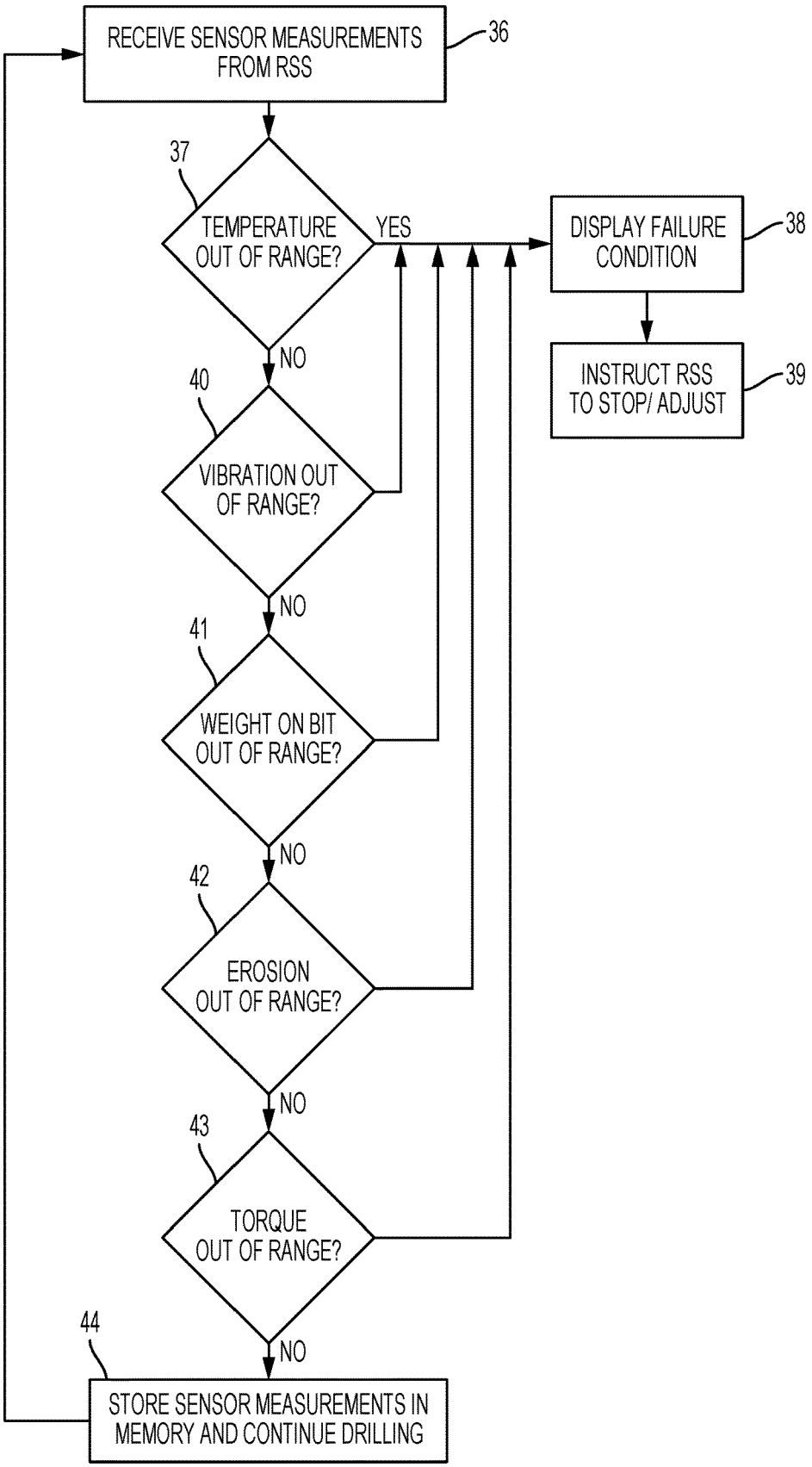
FIG. 6 is a flowchart showing an example process for monitoring an RSS based on sensor measurements.

In an example process shown in FIG. 6, monitoring module 21 may receive sensor measurements from RSS 4 (36). After measurements are received, monitoring module 21 may proceed to analyze each measurement concurrently or sequentially. For example, FIG. 6 shows monitoring module 21 analyzing temperature measurement from one of more temperature sensors, by determining if temperature is out of range (37). An acceptable range may be stored in computer memory as acceptable conditions 20 within stored RSS data 19. In an example, this stored acceptable range may be a baseline, where if the measurement exceeds a baseline, a failure condition is detected. For example, a temperature measurement is received (36) and analyzed to determine if measurement is out of range (37). Determining if temperature is out of range may include comparing the variable, in this example, temperature, to a baseline. If the variable, in this example temperature, exceeds the baseline, monitoring module 21 will detect that the value has exceeded the baseline and send instructions to display failure condition (38). An example of a baseline may be a formation temperature, or operating temperature of 350° F. If the temperature measurement received from temperature sensors at RSS 4 is 500° F., monitoring module 21 would detect that variable, in this example temperature, exceeds the baseline, and send instructions to display a failure condition (38). A failure condition may be based on structural integrity of the shaft.

The display of a failure condition (38) may include a visual indication displayed on a screen of display device 12 to a worker at the drilling site. The display may be on a smart phone of a worker at the drilling site or at a remote location. The alert may be sent, as a text or email, wirelessly to a remote location. The display may include colors indicative of the type of failure condition or the severity of the failure condition detected. Additionally, the alert may signal an audible alarm or lights which alert a worker at the drilling site or on a screen at a remote location. A display on a screen of display device 12 may also include windows which show multiple downhole sensor measurements plotted over time. These measurements represent different downhole drilling parameters received from different sensor types previously described or any type of sensor determining a condition of RSS 4. The plotted measurements may also include the baseline for each sensor measurement which represents a threshold for detecting when a failure is present. The display may also include windows displaying data from each module. These display features may be available for other modules and data from multiple modules may be displayed individually or simultaneously.

In addition to sending instructions to display an alert in response to a failure condition detected, monitoring module 21 may also be programmed to alert when an RSS sensor measurement is quickly changing or rapidly approaching a baseline.

In an example shown in FIG. 6, if a variable exceeds baseline and failure is detected, monitoring module 21 may send instructions to RSS 4 or MWD tool 7 to adjust drilling parameters or to stop the drilling (39). Drilling parameters may include, but are not limited to, parameters that affect the rate of penetration (ROP) of a drilling system, such as rotation speed or angle of the inner shaft, of the drill bit, or of both. If RSS 4 is adjusted in response to a failure condition, monitoring module 21 may continue to analyze the measurements received from the sensor from which the failure condition was detected. Monitoring module 21 may function to analyze these measurements, after the drilling parameters are adjusted, for a certain period of time and if the sensor measurements received do not return to below the baseline level, monitoring module 21 may send instructions to RSS 4 to further adjust the parameters or adjust different drilling parameters. Monitoring module 21 may instruct RSS 4 to stop if the sensor measurements received do not return to below the baseline level.

If the variable, in an example temperature, does not exceed a baseline and no failure condition is detected, monitoring module 21 may proceed with further evaluations by analyzing measurements received from other sensors. For example, in FIG. 6, another measurement to be analyzed is vibration (40). In this case, vibration is the variable and vibration measurements are analyzed to determine if they are out of range by comparing with a baseline. If the baseline is exceeded monitoring module 21 will send instructions to display a failure condition (38) and send instructions to RSS 4 or MWD tool 7 to stop or adjust drilling parameters (39). If the vibration does not exceed a baseline and no failure condition is detected (40), monitoring module 21 will proceed with further evaluations by analyzing measurements received from other sensors, for example in FIG. 6, another measurement could be analyzed could be weight on bit (41). Monitoring module 21 may analyze sensor measurements received and determine if they are out of range, which compares the variable to baseline and determines whether the variable exceeds the baseline. Analyzing received sensor measurements (37, 40, 41, 42, 43) in FIG. 6 may occur simultaneously or in the order displayed in the example of FIG. 6, or in a different order and may receive measurements from other types of sensors associated with RSS 4. As shown in the example of FIG. 6, if the sensor measurements from RSS 4 are within acceptable range, or do not exceed a baseline, monitoring module 21 will store sensor measurements received in computer memory 13 and continue to monitor the RSS 4 will during drilling (44).

Another example module may be calibration module 23 as shown in FIG. 2, which may function to calibrate sensors associated with RSS 4 or sensors located at different locations on downhole assembly 3. Calibration of the sensors associated with RSS 4 may occur before the first use and may occur before each subsequent use. Calibration may occur after a certain length of time RSS 4 has been in use or when RSS 4 has reached a certain life expectancy. Calibration of the sensors before drilling may improve accuracy of other modules 18. Calibration may be used to update stored RSS data 19. One example function of calibration module 23 may be to calibrate sensors associated with RSS 4 before drilling. This may include first receiving measurements from sensors of the same type associated with RSS 4. For example, measurements from sensors 28 and 29 shown in FIG. 3C. In one example sensor measurements from sensors 28 and 29 before drilling may be assumed to be equal or close to equal and a difference in the initial measurements of the sensors 28 and 29 may be considered an error. Error, for example, may be stored as a calibration coefficient or an offset and a calibration coefficient or offset may be applied to sensor measurements received during drilling. In another example, calibration module 23 may function to calibrate the downhole assembly 3 before drilling by comparing RSS sensor measurements to measurements received from additional sensors of the same type located uphole. Difference in initial sensor measurements from sensors of the same type placed at different locations on the downhole assembly 3 may be considered an error. Error, for example, may be stored as a calibration coefficient or an offset and a calibration coefficient or offset may be applied to sensor measurements received during drilling. Calibration module 23 may be initiated automatically before drilling or a display on a screen of display device 12 may prompt a worker at the drilling site using computing system 11 to initiate calibration module 23. Calibration results may be displayed on a screen of display device 12. In one example, calibration module 23 may function to compare the calibration coefficient or error to a baseline stored in computer memory 13, which may represent a threshold for the amount of acceptable error. This baseline may be stored in computer memory 13 with stored RSS data 19 in the form of an acceptable condition 20. If the error exceeds baseline, calibration module 23 may instruct to display an alert on a screen of display device 12. The alert or display may be, but is not limited to, examples which have been described.

Another example module may be efficiency module 24 as shown in FIG. 2, which may function to determine the efficiency of RSS 4 or another component of downhole assembly 3. Efficiency may be described as an indication of how RSS 4, or inner shaft 6, is performing with respect to downhole assembly 3. The efficiency of RSS 4 may be expressed as a comparison between measurements of RSS 4 or inner shaft 6 to another component of downhole assembly 3. Efficiency module 24 may determine efficiency of RSS 4 using measurements received from one or more types of sensors associated with RSS 4. Efficiency module 24 may receive sensor measurements from RSS 4. In one example, the measurements may be temperature. As described, sensors may be placed in different configurations and locations associated with downhole assembly 3 and RSS 4. Temperature measurements may be received from a point within inner shaft 6 of RSS 4 and also may be obtained from the surface of inner shaft 6 of RSS 4. Temperature measurements may also be received from a sensor located uphole of RSS 4, such as near MWD tool 7. Temperature obtained may also be obtained from a sensor on body 5 of RSS 4. Efficiency module 24 may use temperature to determine efficiency, or help determine efficiency using other sensor measurements, by comparing temperature measurements obtained from different downhole assembly components, including but not limited to, RSS 4, body of RSS 5, inner shaft 6 of RSS 4, or MWD tool 7. For example, if a temperature measurement received from the surface of inner shaft 6 is much higher than a temperature measurement received from a sensor located near MWD tool 7, this may indicate higher stress at inner shaft 6. A number of situations may cause this increase in temperature including friction occurring between inner shaft 6 and outer housing 8. Efficiency module 24 may determine, from the comparison between the temperature of inner shaft 6 and MWD tool 7, inner shaft 6 is operating at a lower efficiency than MWD tool 7 of downhole assembly 3. Efficiency module 24 may use measurements received from different sensors or a number of sensors of the same type placed along different points on the downhole assembly 3 including RSS 4. Efficiency module 24 may function to determine RSS 4 is operating more or less efficiently than other components of downhole assembly 3. If RSS 4 is found to be operating less efficiently than other components of downhole assembly 3, life expectancy of RSS 4 may be less than that of other components of downhole assembly 3. When RSS 4 has a lower life expectancy of other components of downhole assembly 3, RSS 4 may fail before other components of downhole assembly 3. Efficiency module 24 may function to compare the calibration coefficient or error to a baseline stored in computer memory 13, which may represent a threshold for the amount of acceptable error. This baseline may be stored in computer memory 13 with stored RSS data 19 in the form of an acceptable condition 20. If the error exceeds baseline, calibration module 23 may instruct to display an alert on a screen of display device 12.

Efficiency module 24 may instruct to alert a worker at the drilling site in a similar manner as that of the other modules and may be in the form of a visual display, on a screen of display device 12 or be in the form of flashing lights or colors. Alerts may also be in the form of an audible alert. Alerts may be sent to a worker in a remote location in the form of a text on a smart phone or an email. The type of alert may depend on level of efficiency calculated by efficiency module 24, for example, how far the calculated efficiency is below the baseline efficiency. For example, if the efficiency of RSS 4 is low and continuing to decrease, the alert may be in the form of a flashing screen or audible alarm. The alert or display may be, but is not limited to, examples which have been described.

All or part of the system and processes described in this specification and their various modifications (subsequently referred to as "the processes") may be controlled at least in part, by one or more computers using one or more computer programs tangibly embodied in one or more information carriers, such as in one or more non-transitory machine-readable storage media. A computer program can be written in any form of programming language, including compiled or interpreted languages, and it can be deployed in any form, including as a stand-alone program or as A module, part, subroutine, or other unit suitable for use in a computing environment. A computer program can be deployed to be executed on one computer or on multiple computers at one site or distributed across multiple sites and interconnected by a network.

Actions associated with controlling the processes can be performed by one or more programmable processors executing one or more computer programs to control all or some of the operations described previously. All or part of the processes can be controlled by special purpose logic circuitry, such as, an FPGA (field programmable gate array), an ASIC (application-specific integrated circuit), or both an FPGA and an ASIC.

Processors suitable for the execution of a computer program include, by way of example, both general and special purpose microprocessors, and any one or more processors of any kind of digital computer. Generally, a processor will receive instructions and data from a read-only storage area or a random access storage area or both. Elements of a computer include one or more processors for executing instructions and one or more storage area devices for storing instructions and data. Generally, a computer will also include, or be operatively coupled to receive data from, or transfer data to, or both, one or more machine-readable storage media, such as mass storage devices for storing data, such as magnetic, magneto-optical disks, or optical disks. Non-transitory machine-readable storage media suitable for embodying computer program instructions and data include all forms of non-volatile storage area, including by way of example, semiconductor storage area devices, such as EPROM (erasable programmable read-only memory), EEPROM (electrically erasable programmable read-only memory), and flash storage area devices; magnetic disks, such as internal hard disks or removable disks; magneto-optical disks; and CD-ROM (compact disc read-only memory) and DVD-ROM (digital versatile disc read-only memory).

Elements of different implementations described may be combined to form other implementations not specifically set forth previously. Elements may be left out of the processes described without adversely affecting their operation or the operation of the system in general. Furthermore, various separate elements may be combined into one or more individual elements to perform the functions described in this specification.

Other implementations not specifically described in this specification are also within the scope of the following claims.

What is claimed is:

1. A drilling system comprising:

a rotary steerable system comprising an inner shaft configured to rotate during drilling performed by the drilling system;

one or more sensors associated with the inner shaft to obtain one or more readings based on drilling performed by the rotary steerable system;

one or more processing devices to receive data based on the one or more readings and to process the data to generate an output based on the one or more readings; and a measurement-while-drilling assembly configured to receive the data from the one or more sensors, and to output the data to the one or more processing devices, where at least one adjustment is made to the rotary steerable system based on the output from the one or more processing devices, where the at least one adjustment comprises controlling a trajectory of the rotary steerable system via the measurement-while-drilling assembly such that the trajectory stays within an envelope of a programmed trajectory, where the output from the one or more processing devices comprises an efficiency rating for the rotary steerable system, and where the at least one adjustment results in an improvement in at least one of a rate of penetration (ROP) and a drilling directional accuracy.

2. The drilling system of claim 1, where the one or more processing devices are part of a computing system located on a surface, and the rotary steerable system is located downhole relative to the surface, and where the data relates to mechanical stresses on the inner shaft.

3. The drilling system of claim 1, where the one or more sensors comprise one or more vibrational sensors to sense vibration during rotation of the shaft, the one or more readings representing vibration of the shaft, and where the one or more vibrational sensors comprises at least one of an accelerometer and a micro-electromechanical (MEMS) device.

4. The drilling system of claim 1, where the one or more sensors comprise one or more torque sensors to sense torque during rotation of the shaft, the one or more readings representing torque experienced by the shaft, the one or more torque sensors comprising at least one of a strain gauge and an angular position sensor.

5. The drilling system of claim 1, where the one or more sensors comprise a single sensor configured to measure both a temperature and at least one vibration of the inner shaft.

6. The drilling system of claim 1, where the one or more sensors comprise one or more temperature sensors to sense a temperature of the shaft while drilling, the one or more readings representing the temperature of the shaft, and where the at least one adjustment further comprises stopping drilling if the temperature of the shaft exceeds a predetermined threshold.

7. The drilling system of claim 1, where the one or more sensors comprise a combination of two or more of the following:

one or more vibrational sensors to sense vibration during rotation of the shaft;

one or more torque sensors to sense torque during rotation of the shaft;

one or more erosion sensors to sense erosion of the shaft as a result of drilling; and one or more temperature sensors to sense a temperature of the shaft while drilling.

8. The drilling system of claim 1, where the output comprises a life expectancy of the rotary steerable system, and where the at least one adjustment further comprises stopping drilling if the life expectancy of the rotary steerable system is less than or equal to thirty minutes.

9. The drilling system of claim 1, where the failure condition is further based on a temperature exceeding a predefined maximum temperature.

10. A method comprising:

associating one or more sensors with an inner shaft of a rotary steerable system, the inner shaft rotating while drilling is performed using the rotary steerable system;

obtaining information based on readings from the one or more sensors during drilling, the readings comprising one or more conditions of the inner shaft;

processing the information to generate an output;

using the output to control drilling, to generate a visual display, or both to control drilling and to generate a visual display, where obtaining the information comprises:

receiving data representing the readings at a measurement-while-drilling assembly, the measurement-while-drilling assembly being connected to the rotary steerable system and generating the information from the readings; and where the information is wirelessly received at one or more processing devices from the measurement-while-drilling assembly, where the inner shaft is coupled to a drill bit, where the one or more sensors comprise at least two torque sensors to sense torque during rotation of the inner shaft, the readings representing torque experienced by the inner shaft, and where the at least two torque sensors span at least one of a connection between the drill bit and the inner shaft and a connection between the inner shaft and the measurement-while-drilling assembly.

11. The method of claim 10, where the rotary steerable system and the measurement-while-drilling assembly are located downhole and the one or more processing devices are part of a computing system located at a surface.

12. The method of claim 10, where the one or more sensors comprise one or more vibrational sensors to sense vibration during rotation of the shaft, the readings representing vibration of the shaft, and where the one or more vibrational sensors comprise at least one piezoelectric sensor.

13. The method of claim 10, where the one or more sensors comprise one or more axial load sensors to measure the weight on the drill bit.

14. The method of claim 13, where the one or more sensors comprise a combination of two or more of the following:

one or more vibrational sensors to sense vibration during rotation of the shaft;

one or more torque sensors to sense torque during rotation of the shaft;

one or more erosion sensors to sense erosion of the shaft as a result of drilling; and one or more temperature sensors to sense a temperature of the shaft while drilling.

15. The method of claim 14, where the output comprises a failure condition of the rotary steerable system, the method further comprising displaying the failure condition if the temperature of the shaft exceeds 500° Fahrenheit.

16. The method of claim 15, where the failure condition is based on a temperature exceeding a predefined maximum temperature, where the maximum temperature is no greater than 200° Fahrenheit above a formation temperature.

17. The method of claim 15, where the failure condition is based on a structural integrity of at least one ball pocket of a bearing assembly, the bearing assembly coupled uphole from the inner shaft.

18. The method of claim 10, where the output comprises the life expectancy of the rotary steerable system.

19. The method of claim 10, where the output comprises an efficiency rating for the rotary steerable system, the method further comprising adjusting a position of the rotary steerable system based on the efficiency rating, where the adjustment to a position of the rotary steerable system results in an improvement in at least one of a rate of penetration (ROP) and a drilling directional accuracy.

20. The method of claim 19, where the efficiency rating is determined by comparing the readings to readings from one or more other sensors uphole of the rotary steerable system.

21.

A method comprising:

associating one or more sensors with an inner shaft of a rotary steerable system, the inner shaft rotating while drilling is performed using the rotary steerable system;

obtaining information based on readings from the one or more sensors during drilling, the readings comprising one or more conditions of the inner shaft processing the information to generate an output;

using the output to control drilling, to generate a visual display, or both to control drilling and to generate the visual display;

calibrating the one or more sensors before drilling and before each subsequent use;

storing at least one calibration error of the one or more sensors; and applying at least one of a calibration offset and a calibration coefficient to at least one sensor measurement received during drilling, where the calibration offset and the calibration coefficient are based on the at least one calibration error.

* * * * *